US005601496A

United States Patent [19]

Beauchamp

[11] Patent Number: 5,601,496

[45] Date of Patent: Feb. 11, 1997

[54] POOL BALL RACK

[76] Inventor: Christopher E. Beauchamp, 601 W. 11th Ave., Apt. 320, Denver, Colo. 80204

[21] Appl. No.: 621,526

[22] Filed: Mar. 25, 1996

[51] Int. Cl.[6] ..... A63D 15/00

[52] U.S. Cl. ..... 473/40

[58] Field of Search ..... 473/40, 41

[56] References Cited

U.S. PATENT DOCUMENTS

| | | | |
|---|---|---|---|
| 376,549 | 1/1888 | Reinert | 473/41 |
| 464,745 | 12/1891 | Sweet | 473/40 |
| 1,052,461 | 2/1913 | Chase | 473/40 |
| 1,089,140 | 3/1914 | Madigan | 473/40 |
| 2,324,945 | 7/1943 | Mistacu | 473/40 |
| 2,405,677 | 8/1946 | Volpe | 473/40 |
| 2,422,939 | 6/1947 | Volpe | 473/40 |
| 3,423,087 | 1/1969 | Sowa | 473/41 |
| 4,591,051 | 5/1986 | Lowman | 473/41 |
| 4,903,965 | 2/1990 | Smith | 473/40 |

*Primary Examiner*—Theatrice Brown
*Attorney, Agent, or Firm*—Merrill N. Johnson

[57] ABSTRACT

An improved rack for forming fifteen pool balls into a compact triangular formation with the ball serving as the apex of the triangle lying over the white spot on the pool table. The rack includes a conventional oversized rack, a strip of resilient material such as rubber attached to the inside surface of the apex of the rack, an elongated pusher panel normally positioned against the inner surface of the rear wall of the rack, means including a pair of helical springs under tension for biasing the pusher panel against the inner surface of the rear wall of the rack, and a rear panel connected to the pusher panel and designed to apply pressure causing the pusher panel to move forward to push the fifteen pools balls into a compact triangular formation.

2 Claims, 1 Drawing Sheet

POOL BALL RACK

FIELD OF THE INVENTION

My invention relates to a rack for arranging fifteen pool balls into a compact triangular formation.

BACKGROUND OF THE INVENTION

To begin most of the many versions of the game of pool, it is necessary to arrange fifteen pool balls into a triangular formation with the ball at the apex of the triangle centered over a white spot on the green table and the five balls forming the base of the triangle lined up parallel to the end of the pool table.

A triangular rack with three similar upstanding walls is traditionally used to effect the foregoing arrangement of the pool balls. To permit convenient loading of the fifteen balls into the rack lying on the pool table, the conventional rack is sized so that the balls fit loosely within the rack. This means that the interior corners of the oversized rack which are smoothly curved will have a radius which somewhat exceeds the radius of the pool balls.

The usual way of arranging the fifteen pool balls within the oversized rack into a compact triangle with the foremost or apex ball of the triangle correctly positioned over the white spot and the five balls at the base of the triangle lying parallel to the end of the pool table has been to move the rack back and forth so that the apex ball rolls back and forth over the white spot. Then the person racking the balls uses his fingers or thumbs trying to push the row of five balls at the base of the triangle forward when the apex ball is stopped lying over the white spot.

However, due to sticky fingers or uneven pressure on the row of five balls or lack of attention by the ball racker or other reasons, the fifteen balls usually do not end up in the desired compact triangle with its apex right over the white spot. Moreover, since the curved interior apex of the rack cannot tightly grip the apex ball due to its larger radius of curvature, the apex ball tends to roll away from the two balls behind it as the rack is removed.

Thus various mechanical means have been employed or at least suggested to achieve the desired compact triangular arrangement of the balls. Elongated solid or tubular cylinders which fit within the rack behind the rearmost row of five balls have been suggested but such cylinders present a problem of removal without disrupting the compact grouping of the balls. Also suggested has been a movable elongated panel or bar which normally lies against the rear wall of the rack but which can be pushed forward during racking to force the balls into a compact triangle. See, for example, Smith U.S. Pat. No. 4,903,965 and the several earlier patents containing similar suggestions cited in Smith '965. But, so far as I am aware, the complicated mechanisms suggested in these patents have not been on sale or met with commercial success.

SUMMARY OF THE INVENTION

I have invented an improved pool ball rack whose use requires less time spent in racking the fifteen balls and results in a firm compact triangle of balls with the front ball directly over the white spot and the rear row of five balls lying parallel to the end of the pool table when the rack is removed.

Briefly put, my improved pool ball rack incorporates a unique feature never used on a pool ball rack, as far as I am aware, and combines this feature with a simplified movable panel biased to lie against the rear wall of an oversized rack.

My improved pool ball rack includes an equilateral triangular frame with three similar upstanding walls, one of which is referred to as the rear wall. The walls of the frame are joined together with smoothly rounded interior corners whose radius of curvature slightly exceeds the circumference of the pool balls. The corner of the frame which lies remote from the rear wall of the frame is called the apex of the frame and it is the corner within which lies the pool ball forming the apex of the triangular formation of fifteen pool balls.

An elongated strip of resilient material preferably natural or artificial rubber is affixed to the smoothly rounded interior surface of the apex of the frame. Preferably the strip is about an inch wide, three eighths of an inch thick and about four inches in length. Thereby the radius of curvature of the apex of the rack now equals the circumference of the apex ball so that the ball can be held rather firmly within the rack.

A first elongated upstanding panel lies against the inside face of the rack's rear wall and is biased to stay close to the rear wall by means which includes a pair of spaced apart cylinders one end of which is affixed to the rear face of the panel. Each cylinder passes through spaced apart holes in the rear wall of the frame and their opposite ends are affixed to a second elongated panel lying outside the frame of the rack. A helical spring under tension surrounds each cylinder with its opposite ends pressing against respectively the rear wall of the frame and the second elongated panel, thereby biasing the first panel against the rear wall.

But when the opposite ends or the center of the second panel is manually pushed toward the rear wall, the first panel will move forward and into contact with the rearmost surfaces of the five pool balls which comprise the last row of balls. The panel applies a firm even pressure which compresses the balls into a compact triangular formation whose rear row of balls will lie parallel to the end of the pool table.

When racking the balls within my improved pool ball rack, the apex ball being firmly held by the strip of resilient material will not roll but instead slides along the surface of the table. As soon as the forth and back motion of the rack stops with the apex ball centered over the white spot, the racker presses the second elongated panel forward toward the rear wall of the rack pushing the first panel into firm contact with the row of five pool balls. When pressure on the second panel is released, the first panel will be biased to its original position and the rack can now be removed, leaving a compact triangle of pool balls with its apex ball centered over the white dot and the rear balls aligned parallel with the rear end of the pool table.

DETAILED DESCRIPTION OF THE PREFERRED EMBODIMENT

Figure 1:
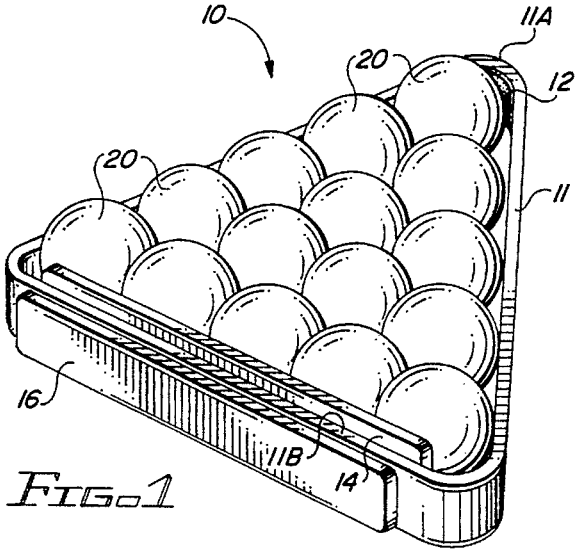
FIG. 1 is a perspective view showing my improved pool ball rack containing the fifteen pool balls which are not part of the invention.
Figure 2:
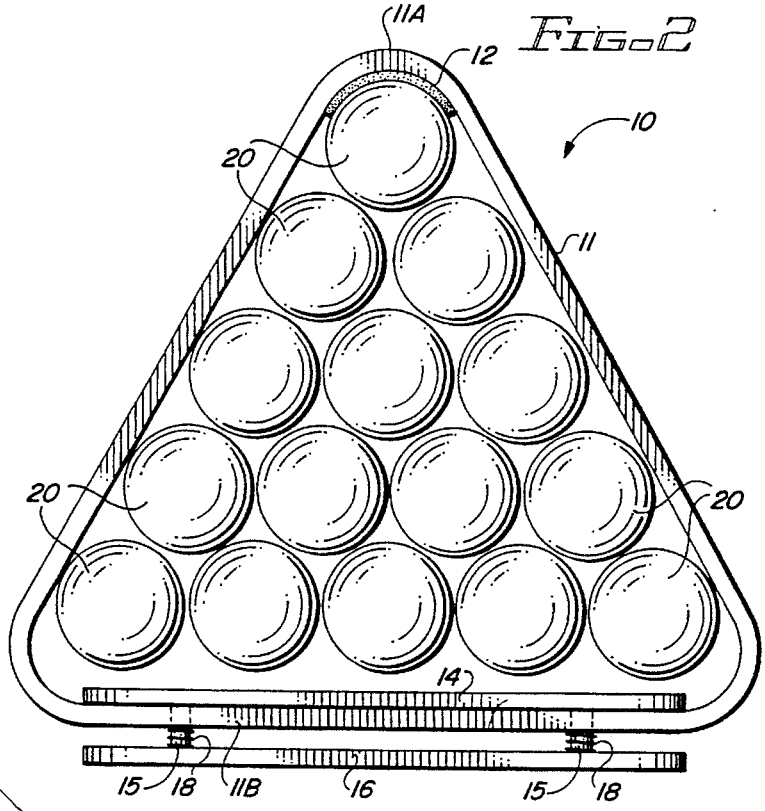
FIG. 2 is a top plan view of the rack shown in FIG. 1.

Referring to FIGS. 1 and 2 of the appended drawings, my improved pool ball rack 10 includes a conventional oversized triangular frame 11 having an apex 11A and three equal upstanding walls including rear wall 11B. The three walls of frame 11 are joined with smoothly rounded interior corners whose radius of curvature slightly exceeds the circumference of the pool balls.

As best shown in FIG. 2, improved pool ball rack 10 includes an elongated strip 12 made of resilient material such as rubber glued or otherwise affixed to the interior surface of the frame's apex 11A. Strip 12 is preferably about an inch in width, three eighths of an inch thick and about four inches in length. Thus the radius of curvature of the apex of rack 10 now about equals the circumference of the pool ball which forms the apex of the fifteen balls within the frame of rack 10 so that the apex ball 20 can be rather firmly held within the rack.

The fifteen pool balls 20 are pushed into a compact triangle by a first elongated panel 14 which normally lies against the interior surface of rear wall 11B. Pusher panel 14 is biased to remain close to wall 11B by means which include a pair of cylinders 15, rear panel 16, and a pair of helical springs 18.

Figure 3:
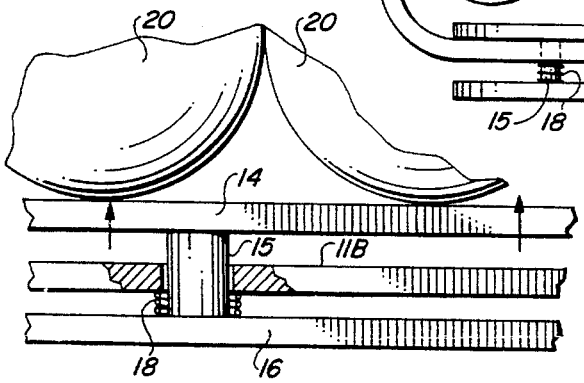
FIG. 3 is a detailed view partially broken away showing the helical spring loaded mechanism for biasing the first panel against the rear wall of the rack.

One end of each cylinder 15 is affixed to the back side of pusher panel 14 and the opposite end of each cylinder is passed through a hole in wall 11B as best shown in FIG. 3 and affixed to the front side of second panel 16. A helical spring 18 under tension surrounds each of the two cylinders 15 with one end of the spring pushing against the rear surface of wall 11B and the other end of the spring pushing against the front face of rear panel 16, thus biasing pusher panel 14 flush against rear wall 11B.

By pressing the fingers of both hands against the opposite sides of the frame and both thumbs pressing against opposite ends of second panel 16, the first panel will move forward to push against the rearmost row of five pool balls 20 to firmly and equally urge the fifteen pool balls into a close compact arrangement. Then when thumb pressure is released from second panel 16, first panel 14 is biased against the interior surface of rear wall 11B.

While I have shown and described my improved pool ball rack in detail, such disclosure is not intended to limit applicant's invention to or by such description. The invention is defined only in the appended claims.

I claim:

1. A pool ball rack for compact triangular arrangement of fifteen pool balls on a pool table comprising an equilateral triangular frame having three similar upstanding walls including a rear wall, the walls joined together with smoothly rounded interior corners including the apex of the frame which lies remote from the rear wall, the frame sized to enclose and loosely group fifteen pool balls;

a strip of resilient material affixed to the smoothly rounded interior of the apex of the frame designed to prevent rotation during racking of the pool ball which forms the apex of a triangle of fifteen pool balls;

a first elongated upstanding panel positioned against the inner surface of the rear wall of the frame;

means including a pair of helical springs designed to bias the first elongated panel against the rear wall of the frame; and a second elongated upstanding panel positioned outside the frame lying parallel to the rear wall of the frame and connected to the biasing means for pushing the first elongated panel toward and against the five rearmost pool balls immediately following the racking of the balls to form the fifteen pool balls into a compact triangular formation.

2. A pool ball rack as set forth in claim 1 in which the strip of resilient material is made of rubber.

* * * * *